US007435709B2

(12) United States Patent
Stonebraker et al.

(10) Patent No.: US 7,435,709 B2
(45) Date of Patent: Oct. 14, 2008

(54) LINEAR ALKYLPHENOL DERIVED DETERGENT SUBSTANTIALLY FREE OF ENDOCRINE DISRUPTIVE CHEMICALS

(75) Inventors: Peter Michael Stonebraker, Novato, CA (US); Curtis B. Campbell, Hercules, CA (US); Linda Susan Gordon Roberts, Suisun City, CA (US)

(73) Assignee: Chevron Oronite Company LLC, San Ramon, CA (US)

( * ) Notice: Subject to any disclaimer, the term of this patent is extended or adjusted under 35 U.S.C. 154(b) by 408 days.

(21) Appl. No.: 11/218,390

(22) Filed: Sep. 1, 2005

(65) Prior Publication Data

US 2007/0049508 A1 Mar. 1, 2007

(51) Int. Cl.
*C07C 37/66* (2006.01)

(52) U.S. Cl. ..... 508/586

(58) Field of Classification Search ..... 508/585, 508/398, 374

See application file for complete search history.

(56) References Cited

U.S. PATENT DOCUMENTS

| | | | | |
|---|---|---|---|---|
| 3,657,124 | A * | 4/1972 | Love | 508/586 |
| 4,123,371 | A | 10/1978 | Hori et al. | |
| 4,514,313 | A | 4/1985 | Le Coent | |
| 4,643,838 | A | 2/1987 | Liston et al. | |
| 4,744,921 | A | 5/1988 | Liston | |
| 4,857,218 | A * | 8/1989 | Meschke et al. | 508/223 |
| 4,952,328 | A * | 8/1990 | Davis et al. | 508/237 |
| 5,141,657 | A * | 8/1992 | Fetterman et al. | 508/192 |
| 5,244,588 | A | 9/1993 | Koshima et al. | |
| 5,262,508 | A | 11/1993 | Martella et al. | |
| 5,318,710 | A | 6/1994 | Campbell | |
| 5,320,762 | A | 6/1994 | Campbell | |
| 5,320,763 | A | 6/1994 | Campbell | |
| 5,434,293 | A | 7/1995 | Campbell | |
| 5,808,145 | A | 9/1998 | Le Coent et al. | |
| 6,001,785 | A | 12/1999 | Le Coent et al. | |
| 6,114,288 | A * | 9/2000 | Fujitsu et al. | 508/371 |
| 6,162,770 | A | 12/2000 | Le Coent et al. | |
| 6,291,408 | B1 | 9/2001 | Le Coent et al. | |
| 6,296,782 | B1 * | 10/2001 | Schnur et al. | 252/68 |
| 6,348,438 | B1 | 2/2002 | Le Coent et al. | |
| 6,515,169 | B1 | 2/2003 | Marinangeli et al. | |

FOREIGN PATENT DOCUMENTS

| | | |
|---|---|---|
| EP | 0 486 893 A1 | 5/1992 |
| EP | 1 548 089 | 6/2005 |

OTHER PUBLICATIONS

Ambient Aquatic Life Water Quality Criteria for Nonylphenol—Draft, United States Environmental Protection Agency, Office of Water 4304T, EPA 822-R-03-029, Dec. 2003, pp. 1-71, www.epa.gov/waterscience/criteria/nonphenol/.

Watanabe et al., Tissue-specific estrogenic and non-estrogenic effects of a xenoestrogen, nonlyphenol, Journal of Molecular Endocrinology, (2004), pp. 243-252, vol. 33, © 2004 Society of Endocrinology, Printed in Great Britain, 0952-5041/04/033-243, www.endocrinology.org.

Tabira et al., Structural requirements of *para*-alkylphenols to bind to estrogen receptor, Eur. J. Biochem, (1999), pp. 240-245, vol. 262, © FEBS 1999.

Routledge et al., Structural Features of Alkylphenolic Chemicals Associated with Estrogenic Activity, The Journal of Biological Chemistry, 1997, pp. 3280-3288, vol. 272, No. 6, Issue of Feb. 7, © 1997 by the American Society for Biochemistry and Molecular Biology, Inc., www.-jbc.stanford.edu/jbc/.

Alkylphenols & Ethoxylates Research Council, Alkylphenols and Alkylphenol Ethoxylates, An Overview of Safety Issues, Jan. 1999, APE Research Council: White Paper, pp. 1-9, www.aperc.org/docs/whitepaper-overview.html.

George et al., Final Report, Assessment of Pubertal Development and Thyroid Function in Juvenile Female CD ® (Sprague-Dawley) Rats After Exposure to Selected Chemicals Administered by Gavage on Postnatal Days 22 to 42/43, RTI Identification No. 65U-08055.001.015.002, RTI Protocol No. RTI-830, pp. 1-52, www.epa.gov/scipoly/oscpendo/assayvalidation/status.html, Mar. 28, 2005.

* cited by examiner

*Primary Examiner*—Walter D. Griffin
*Assistant Examiner*—Frank C Campanell

(57) ABSTRACT

Disclosed is a lubricating oil composition displaying reduced endocrine disruption response, comprising a major amount of an oil of lubricating viscosity; and a detergent comprising an unsulfurized alkali or alkaline earth metal salt of a reaction product of (1) an olefin having at least 10 carbon atoms, wherein greater than 80 mole % of the olefin is a linear $C_{20}$-$C_{30}$ n-alpha olefin, wherein less than 10 mole % of the olefin is a linear olefin of less than 20 carbon atoms, and wherein less than 5 mole % of the olefin is branched chain olefin of 18 carbons or less, and (2) a hydroxyaromatic compound.

15 Claims, No Drawings

LINEAR ALKYLPHENOL DERIVED DETERGENT SUBSTANTIALLY FREE OF ENDOCRINE DISRUPTIVE CHEMICALS

FIELD OF THE INVENTION

The present invention relates to an unsulfurized phenate detergent, derived substantially from a straight chain normal alpha olefin. The resulting straight chain detergent additive was determined to be substantially free of endocrine disruptive chemicals when the effects were quantified on pubertal development and thyroid function in the intact juvenile female rat.

BACKGROUND OF THE INVENTION

There is increasing evidence that certain synthetic and natural chemicals may act as agonists or antagonists to estrogens or androgens and may interfere in multiple ways with the action of thyroid hormones; such compounds can be called endocrine disruptors. For example, endocrine disruptors can mimic or block chemicals naturally found in the body, thereby altering the body's ability to produce hormones, interfering with the ways hormones travel through the body, and altering the concentration of hormones reaching hormone receptors.

Endocrine disruptors and natural estrogens share a common mechanism of action. In normal cases, estrogenic activity is produced by binding natural estrogen to an estrogen receptor (ER) within the nucleus of the cell, followed by transcriptional activation of these occupied ERs. When endocrine disruptors are present, normal estrogenic activity is supplanted when endocrine disruptors bind an ER, causing transcriptional activation of the ER even though no natural estrogen is present. Similarly, antiestrogenic activity is produced by endocrine disruptors which bind to ERs but which do not subsequently activate the occupied ER as well as natural estrogen. Finally, selective estrogen receptor modulators (SERMs) bind to ERs, but subsequently activate cellular responses that differ from those activated by the natural estrogens. In general, all but a very small number of molecules that bind to ERs produce some activation of the receptors, as either estrogens or as SERMs.

Examples of suspected endocrine disruptors may include, for example: Dioxin, Polychlorinated biphenyls (PCBs), Polybrominated biphenyls (PBBs), Hexachlorobenzene (HcB), Pentachlorophenol (PCP), 2,4,5-Trichlorophenoxy acetic acid (2,4,5-T), 2,4-Dichlorophenoxyacetic acid (2,4-D), alkylphenols such as Nonylphenol or Octylphenol, Bisphenol A, Di-2-ethylhexyl phthalate (DEHP), Butylbenzyl phthalate (BBP), Di-n-butyl phthalate (DBP) Dicyclohexyl phthalate (DCHP), Diethyl phthalate (DEP), Benzo (a) pyrene, 2,4-Dichlorophenol (2,4-DPC), Di(2-ethylhexyl)adipate, Benzophenone, P-Nitrotoluene, 4-Nitrotoluene, Octachlorostyrene, Di-n-pentyl phthalate (DPP), Dihexyl phthalate (DHP), Dipropyl phthalate (DprP), Styrene dimers and trimers, N-Butyl benzene, Estradiol, Diethlhexyl adipate, Diethlhexyl adipate (DOA), trans-cholordane, cis-cholordane, p-(1,1,3,3-Tetramethlbutyl)phenol (TMBP), and (2,4-Dichlorophenoxy)acetic acid (2,4-PA).

Alkylphenols and products produced by them have come under increased scrutiny due to their association as potential endocrine disruptive components. This is namely due to the weak estrogenic activity of base alkylphenol as well as degradation intermediates of the alkylphenol products. Alkylphenols commercially are used in herbicides, gasoline additives, dyestuffs, polymer additives, surfactants, lubricating oil additives and antioxidants. In the recent years, alkylphenol alkoxylates, such as ethoxylated nonylphenol, have been criticized for having poor biodegradability, high aquatic toxicity of the by-products of the biodegradation of the phenol portion, and there is an increasing concern that these chemicals may act as endocrine disrupters. Some studies have shown there to be links between alkylphenols and declining sperm count in human males and there is evidence that alkylphenols may harmfully disrupt the activity of human estrogen and androgen receptors. Specifically, Routledge et al., *Structural features of alkylphenolic chemicals associated with estrogenic activity,* J Biol Chem., 1997 Feb. 7; 272(6): 3280-8, compared different alkylphenols estrogenic activity in an estrogen-inducible strain of yeast comparing the assays with 17β-estradiol. The results indicated that optimal estrogenic activity requires a single branched alkyl group composed of between 6 and 8 carbon atoms located at the para position on an otherwise unhindered phenol ring with 4-tert-octylphenol (8 carbons also named 4-(1,1,3,3-Tetramethylbutyl)-phenol)) having the highest activity. Routledge et al., tested various alkylphenols in the assay and indicated that alkyl chain length, degree of branching, location on the ring, and degree of isomeric heterogeneity affect the binding efficiency but was not able to draw a structure activity conclusion. For example, Routledge et al., stated that the p-nonylphenol as determined by high resolution gas chromatographic analysis identified 22 para-isomers speculating that all isomers would not have similar activity without elucidating the active species. Interestingly, Tabria et al., *Structural requirements of para-alkylphenols to bind to estrogen receptor,* Eur. J. Biochem. 262, 240-245 (1999) found that when using human estrogen receptors, the receptor binding of alkylphenols was maximized when the number of alkyl carbons was nine carbon atoms. Tabria et al., noted that branched chain nonylphenol, mixture of isomers (commercially available and which did not contain any n-nonylphenol) was almost as active as n-nonylphenol.

Nonylphenol ethoxylate and octylphenol ethyoxylate are widely used as nonioionic surfactants. Concern over the environmental and health impact of these alkoxylated alkylphenols has led to governmental restriction on the use of these surfactants in Europe, as well as voluntary industrial restrictions in the United States. Many industries have attempted to replace these preferred alkoxylated alkylphenol surfactants with alkoxylated linear and branched alkyl primary and secondary alcohols, but have encountered problems with odor, performance, formulating, and increased costs. Although the predominate focus has been on the alkylphenol ethoxylates and the potential problems associated these compounds and primarily with the degradation by-products, there remains a need to review other components to select combinations that have similar or improved performance benefits with reduced negative impacts.

Nonylphenol and dodecylphenol can be produced by the following steps: propylene oligomerization and separation of propylene trimer and tetramer, and phenol alkylation with propylene trimer and separation of nonylphenol, or phenol alkylation with propylene tetramer and separation of dodecylphenol. Tetrapropenyl phenol prepared from propylene tetramer has been widely used in the lubricant additive industry. Tetramer is a cost effective olefin to manufacture; the highly branched chain of 10 to 15 carbons with high degree of methyl branching imparts exceptional oil solubility and compatibility with other oil soluble lubricant additive components. Dodecylphenol derived from propylene tetramer is primarily used as in an intermediate in the production of additives for lubricating oils, commonly sulfurized alkyl phenate detergents. To a lesser degree, these branched phenate detergents have employed some degree of linear olefin.

U.S. Pat. No. 3,036,971 discloses preparing detergent dispersant additives based on sulfurized alkylphenates of high basicity alkaline earth metals, wherein the alkyl group is derived from propylene tetramer. These additives are prepared by sulfurization of an alkylphenol, neutralization of the sulfurized alkylphenol with an alkaline earth base, and then super-alkalization by carbonation of the alkaline earth base dispersed in the sulfurized alkylphenate. Similar metal overbased sulfurized alkylphenate compositions are described for example in U.S. Pat. Nos. 3,178,368; 3,367,867; and 4,744,921, with the latter disclosing phenates derived from a mixture of linear and branched alkylphenols using a sulfurization catalyst.

U.S. Pat. No. 5,320,763 discloses a metal overbased sulfurized alkylphenate derived from alkylphenols enriched in $C_{10}$ to $C_{16}$ alkyl substituents attached to the phenol ring in the "end" position. Similarly, U.S. Pat. Nos. 5,318,710 and 5,320,762 are directed to overbased sulfurized alkylphenates derived from alkylphenols from internal olefins, and thus are enriched in middle and skewed attachment. In all of these disclosures, the alkyl groups may contain a large portion of trisubstituted and tetrasubstituted carbon atoms and thus have a large degree of quaternary carbons.

U.S. Pat. No. 5,244,588 discloses a process for producing overbased sulfurized alkaline earth metal phenates having a base value of 240 to 330 mg KOH/g, which comprises reacting alkylphenol, prepared from $C_{14-28}$ straight-chain alkene and phenol, with sulfur, alkaline earth metal compound and dihydric alcohol to prepare a reaction mixture, then distilling off water and dihydric alcohol from the reaction mixture, subsequently treating the reaction mixture with carbon dioxide to give basic sulfurized alkaline earth metal phenates, and further subjecting to overbasification using a solvent containing aromatic hydrocarbon and at least one of monohydric alcohol and water.

SUMMARY OF THE INVENTION

The present invention is directed in part, to an oil soluble lubricating detergent additive derived primarily from an unsulfurized alkali or alkaline earth metal salt of a reaction product of a hydroxyaromatic with a predominant amount of a linear olefin. The resulting derived straight chain detergent additive was determined to be substantially free of endocrine disruptive chemicals when the effects were quantified on pubertal development and thyroid function in the intact juvenile female rat. Thus, in one aspect, this particular detergent can be employed in formulations which require reduced affects for mammalian exposures.

Thus, disclosed is a lubricating oil composition comprising:

a) a major amount of an oil of lubricating viscosity; and b) a detergent comprising an unsulfurized alkali or alkaline earth metal salt of a reaction product of (1) an olefin having at least 10 carbon atoms, wherein greater than 80 mole % of the olefin is a linear $C_{20}$-$C_{30}$ n-alpha olefin, wherein less than 10 mole % of the olefin is a linear olefin of less than 20 carbon atoms, and wherein less than 5 mole % of the olefin is branched chain olefin of 18 carbons or less, and (2) a hydroxyaromatic compound.

Preferably the linear olefin is derived from the oligomerization of ethylene. These linear olefins can be prepared in such a fashion that they may contain a large degree of n-alpha olefin content. Typically these olefins contain a mixture of even numbered carbon atoms cut to particular fractions if desired. These $C_{20}$-$C_{30}$ cuts are preferably mixtures of $C_{20}$-$C_{22}$, $C_{20}$-$C_{24}$, $C_{24}$-$C_{28}$, $C_{26}$-$C_{28}$, $C_{30+}$ linear groups, and as advantageously these mixtures are coming from the polymerization of ethylene. These particular cuts can be further blended to create distinct blend of different carbon number cuts within the desired range. Thus, in one aspect, a preferred mixture of alpha olefins is a mixture containing a major amount of $C_{20}$ and $C_{22}$ n-alpha olefins. In another aspect, the alpha olefin contains from about 60 to 90 weight % of a $C_{20}$ to $C_{24}$ alpha olefin and from 40 to 10 weight % of $C_{26}$ and $C_{28}$ alpha olefins.

Among other factors, this invention is directed to the surprising discovery that the particularly claimed detergent additive and accordingly, the composition containing such, have reduced estrogenic and anti-estrogenic activity when assessed in a modified version of the toxicology screen test referred to as the female pubertal assay. This assay is responsive to endocrine endpoints for the reproductive and thyroidal endocrine systems and therefore can be used to determine whether compounds are substantially free of endocrine disruptive chemicals. Accordingly, in one aspect, this invention is directed to the use of said detergent additive (defined in b above) with an oil of lubricating viscosity to form a lubricating oil composition; wherein said composition is formulated such that, the composition is determined by a mammalian assay to be substantially free of endocrine disruptive chemicals. Thus, this aspect relates to the use of a lubricating oil composition comprising an oil of lubricating viscosity and a detergent additive characterized as being substantially free of endocrine disruptive compounds, wherein said detergent comprises a sulfurized or unsulfurized alkali or alkaline earth metal salt of a reaction product of (1) an olefin having at least 10 carbon atoms, wherein greater than 80 mole % of the olefin is a linear $C_{20}$-$C_{30}$ n-alpha olefin, wherein less than 10 mole % of the olefin is a linear olefin of less than 20 carbon atoms, and wherein less than 5 mole % of the olefin is branched chain olefin of 18 carbons or less, and (2) a hydroxyaromatic compound. Thus, in one aspect the detergent is sulfurized. In yet another aspect, the detergent is unsulfurized. The determination of endocrine disruption can be determined by numerous assays know in the art. Preferably, the assay is a mammalian assay such as that quantified by a pubertal development assay. In the pubertal development assay, evidence of endocrine disruption can be measured by a decrease in days to vaginal opening or decrease in body weight at sexual maturation. These endocrine disruption assays can be repeated for different detergent compounds and used as a screening method to form a library of such assay results. The library can be quantified to determine the severity of the endocrine disruptive effect and thus reduced endocrine disruptive formulations can be predicted.

Several branched chain alkylphenol derived detergents are known or suspected to act as endocrine disruptors. Thus another aspect may be directed to a process for reducing the endocrine disrupting properties of a lubricant composition suitable for use in internal combustion engine applications, by replacing the known or suspected endocrine disrupting detergent with the claimed detergent additive, further described in component b) above.

DETAILED DESCRIPTION OF THE INVENTION

As used herein the expression "endocrine disrupter" is a compound which disrupts normal regulation of the endocrine system; in particular, the endocrine system that regulates reproductive processes.

The term "alpha olefin" or "1-olefin" refers to a monosubstituted olefin that has the double bond in the terminal portion or 1-position. They have the following structure: $CH_2{=}CHR_q$ where $R_q$ is an alkyl group.

The term "n-alpha olefin" refers to an alpha olefin as described above $R_q$ is a linear alkyl group.

The term "1,1-disubstituted olefin" refers to a disubstituted olefin, also called a vinylidene olefin, that has the following structure: $CH_2{=}CR_sR_t$ where $R_s$ and $R_t$ are not hydrogen, and may be the same or different, and constitute the rest of the olefin molecule. Preferably, either $R_s$ or $R_t$ is a methyl group, and the other is not.

The term "base number" or "BN" refers to the amount of base equivalent to milligrams of KOH in one gram of sample. Thus, higher BN numbers reflect more alkaline products, and therefore a greater alkalinity reserve. The BN of a sample can be determined by ASTM Test No. D2896 or any other equivalent procedure.

The term "overbased alkaline earth alkyl phenate" refers to a composition comprising a diluent (e.g., lubricating oil) and an alkyl phenate wherein additional alkalinity is provided by a stoichiometric excess of an alkaline earth metal base, based on the amount required to react with the acidic moiety of the phenate. Enough diluent should be incorporated in the overbased phenate to ensure easy handling at safe operating temperatures.

The term "low overbased phenate" refers to an overbased alkaline earth alkyl phenate having a BN of about 2 to about 60.

The term "high overbased phenate" refers to an overbased alkaline earth alkyl phenate having a BN of about 100 to about 300, or more. Generally a carbon dioxide treatment is required to obtain high BN overbased detergent compositions. It is believed that this forms a colloidal dispersion of metal base.

In one embodiment, the present invention employs an oil of lubricating viscosity and a particular detergent comprising an unsulfurized alkali or alkaline earth metal salt of a primarily straight chain alkylphenol derived from the reaction of a $C_{20}$-$C_{30}$ alpha olefin having greater than 80 weight % n-alpha olefin content with a phenol, with the proviso that the detergent contains less than 10 weight % of an alkylphenol derived from a linear olefin of less than 20 carbon atoms, and with the further proviso that the detergent contains less than 5 weight % of an eighteen carbon atom or less branched chain alkylphenol, or salts thereof. Preferably, the detergent is substantially free of any alkylphenols having less than 16 chain carbon atoms attached in the para position on the phenol. By substantially free it is preferred that that the detergent would have less than 5 wt % of these compounds and more preferably less than 1 wt % based upon the total weight percent of alkylphenol in the detergent.

The detergent of the present invention has a particularly long tail from the olefin pendent to the hydroxyaromatic moiety, which aids in oil solubility of the compound and which may influence the estrogenic activity of the compound. Alkylation process conditions and alkylation catalysts are selected to maintain the linearity of the olefin and prevent skeletal isomerization and bond migration to form internal isomers, and moreover, the formation of tertiary carbenium ion intermediates. These tertiary carbenium ions further react with the hydroxyaromatic and form quaternary carbons or simply "quats". Preferably, the linear olefin is selected so that it forms a detergent with less than 15 mole % quaternary carbons, more preferably less than 5 mole % and even more preferably less than one mole % quaternary carbons derived from the linear olefin. Preferably the quats are end quats and thus, they are positioned at the beta or gamma carbon of the olefin and thus after alkylation are proximal to the hydroxyaromatic ring. Internal quats can lead to unwanted branching and biodegradation issues. Thus, the olefin is selected as having at least 10 carbon atoms, wherein greater than 80 mole % of the olefin is a $C_{20}$-$C_{30}$ n-alpha olefin, wherein less than 10 mole % of the olefin is a linear olefin of less than 20 carbon atoms, and wherein less than 5 mole %, more preferably from about 0 to 2.5 mole %, of the olefin is branched chain olefin of 18 carbons or less. Preferably the linear olefin has less than 15 mole % of 1,1-disubstituted olefin, and even more preferably less than 10 mole % of 1,1-disubstituted olefin.

In order to prepare the detergent, a particular linear $C_{20-30}$ alkyl hydroxyaromatic is used as a raw material which is derived from the reaction of a $C_{20}$-$C_{30}$ alpha olefin having greater than 80 weight % n-alpha olefin content with a phenol or other hydroxyaromatic. A preferred catalyst for alkylating the phenol with the appropriate straight chain olefin is a sulfonic acid resin catalyst such as Amberlyst 15® or Amberlyst 36® both of which are commercially available from Rohm and Hass, Philadelphia, Pa. In the alkylation reaction, an equal molar ratio of reactants may be used. Preferably, a molar excess of phenol (hydroxyaromatic) can be employed, e.g., 2-10 equivalents of phenol for each equivalent of olefin with unreacted phenol recycled. The latter process maximizes monoalkylphenol while minimizing the amount of unreacted olefin reagent. Typically the alkylation reaction is run neat, without the addition of a solvent or diluent oil, however such can be used. Examples of inert solvents include benzene, toluene, chlorobenzene, mixture of aromatics, paraffins and naphthenes.

The olefin employed in the present invention contains a high amount of n-alpha olefin content, such that the total alpha olefin reactant contains at least 80 wt % n-alpha olefin content, preferably greater than 83 wt % and more preferably greater than 85 wt %. Examples of the n-alpha olefins include 1-octadecene, 1-eicosene, 1-docosene, 1-tetracosene, 1-hexacosene, 1-octacosene and 1-triacontene. Commercially available n-alpha olefin fractions that can be used include the $C_{20-24}$ alpha-olefins, $C_{20-22}$ alpha-olefins, $C_{24-28}$ alpha-olefins, $C_{26-28}$ alpha-olefins, and $C_{20-26}$ alpha-olefins etc. These alpha olefins are sold under the product name Neodene® by Shell Chemicals and by Chevron Phillips Chemical Company and BP Chemical Company. Mixtures of the commercially available alpha olefins may be used. Preferably these olefins have a relatively low content of vinylidene isomer typically less than 10 wt %. Particularly preferred olefins may contain a minor amount of linear internal olefin and preferably contain less than 5 wt % based upon the total weight % of the olefins employed.

Suitable alpha olefins can be derived from the ethylene chain growth process. This process yields even numbered straight chain 1-olefins from a controlled Ziegler polymerization. Non-Ziegler ethylene chain growth oligomerization routes are also known in the art. Other methods for preparing the alpha olefins of this invention include wax cracking as well as catalytic dehydrogenation of normal paraffins. However, these latter processes typically require further processing techniques to provide a suitable alpha olefin carbon distribution. The procedures for the preparation of alpha olefins are well known to those of ordinary skill in the art and are described in detail under the heading "Olefins" in the Encyclopedia of Chemical Technology, Second Edition, Kirk and Othmer, Supplement, Pages 632-657, Interscience Publishers, Div. of John Wiley and Son, 1971, which is hereby incorporated by reference.

The $C_{20}$ to $C_{30}$ linear mono alpha olefins obtained by direct oligo-polymerization of ethylene, can be characterized as having an infrared absorption spectrum which exhibits an absorption peak at 908 $cm^{-1}$, characteristic of the presence of an ethylene double bond at the end of the chain, on the carbon atoms occupying positions 1 and 2 of the olefin: also distinguished therein are two other absorption peaks at wavelengths of 991 and 1641 $cm^{-1}$.

The hydroxyaromatic compounds which may be alkylated in accordance with the process of the present invention include mononuclear monohydroxy and polyhydroxy aromatic hydrocarbons having 1 to 4, and preferably 1 to 3, hydroxy groups. Suitable hydroxyaromatic compounds include phenol, catechol, resorcinol, hydroquinone, pyrogallol, cresol, and the like. The preferred hydroxyaromatic compound is phenol.

Typically, the derived linear alky hydroxyaromatic compound used in the present process will be a mixture of different n-alpha olefin groups, e.g., having a distribution of alkyl groups as opposed to a single isomer, however, single isomers and narrow distributions are contemplated. Typically, only a minor amount of dialkylate is employed, thus the dialkylate ranges from 0 wt % to less than 5 wt % of the initial alkyl hydroxyaromatic charge. Particularly preferred alkyl hydroxyaromatic compounds are alkylphenols. These linear alkylphenols—have the n-alpha olefin primarily attached to the phenol ring in the ortho and para positions. Thus, preferably the ortho and para positions are minimally at least 80 wt %, and more preferably at least 85 wt % and even more preferred at least 90 wt % of the linear alkylphenol product. Particularly preferred linear alkylphenols have a para content of less than 90 wt % and more preferably less about than 60 wt %, with the remainder being primarily ortho substituted. Thus, one aspect is directed to high ortho content alkylphenols wherein the ortho content is greater than the para content. By employing a predominate amount of n-alpha olefin and controlling the alkylation conditions, a large degree of the alkyl carbon chain of the linear olefin is attached on the 2-position of the alkyl chain to the phenol ring. The attachment position of the alkyl carbon chain to the phenol moiety can be determined by gas chromatograph (GC) and quantitative $^{13}C$-nuclear magnetic resonance spectroscopy (NMR). Thus, this 2 phenol attachment can be from 25 to 50 mole % based on the total amount.

Numerous methods are known in the art to neutralize alkyl hydroxyaromatics and to produce basic phenates by incorporation of excess alkali metal or alkaline earth metal, typically excess alkaline earth metal oxides or hydroxides, over the theoretical amounts required to form the normal phenate. Such processes are typically conducted in a suitable diluent and commonly with other promoters: such as diols, e.g. $C_2$ to $C_4$ allkylene glycols, preferably ethylene glycol; and/or high molecular weight alkanols (generally $C_8$ to $C_{16}$, e.g. decyl alcohols, 2-ethyl hexanol); and/or carboxylic acids, etc. The reaction mixture is then heated to reaction temperature for a suitable period of time to form the reaction product, optionally the product is distilled to remove impurities, and/or optionally carboxylated by incorporation of carbon dioxide. The dilution oils suitable for use in the above processes include naphthenic oils and mixed oils and preferably paraffinic oils such as neutral 100 oil. The quantity of dilution oil used is such that the amount of oil in the final product constitutes from about 25% to about 65% by weight of the final product, preferably from about 30% to about 50%.

According to one aspect, an overbased, hydrocarbyl phenate is prepared by a process comprising the steps of: (a) neutralizing an alkylphenol with an alkaline earth base in the presence of a dilution oil, a glycol, and halide ions, the glycol being present in the form of a mixture with an alcohol having a boiling point above 150° C.; (b) removing alcohol, glycol, and water from the medium, preferably by distillation; (c) removing sediment from the medium, preferably by filtration; (d) carbonating the resultant medium with $CO_2$ (optionally in the presence of halide ions); and (e) removing alcohol, glycol, and water from the medium, preferably by distillation. The halide ions which may be employed in the process are preferably $Cl^-$ ions which may be added in the form of ammonium chloride or metal chlorides such as calcium chloride or zinc chloride.

Another process for producing a suitable phenate is outlined below. The linear alkylphenol is neutralized with an alkali metal base and/or an alkaline earth base in a diluent oil. Typically, these metal bases are the hydrides, oxides, or hydroxides of the alkali or alkaline earth metal. Particularly preferred are the divalent metals, these alkaline earth bases include the oxides or hydroxides of: calcium, magnesium, barium, or strontium; and particularly of calcium oxide, calcium hydroxide, magnesium oxide, magnesium hydroxide, and mixtures thereof. In one embodiment, lime and dolomite is preferred with slaked lime (calcium hydroxide) being particularly preferred. In the particularly preferred neutralization step, the molar ratio of metal base/alkylphenol is selected from about 0.5:1 to 1.1:1, preferably 0.7:1 to 0.8:1; the molar ration of alkaline earth base/alkylphenol is selected from about 0.2:1 to 0.7:1, preferably 0.3:1 to 0.5:1. To this mixture is added a $C_1$ to $C_4$ carboxylic acid, suitable acids used in this step include formic, acetic, propionic and butyric acid, and may be used alone or in mixture. Preferably, a mixture of acids is used, most preferably a formic acid and acetic acid mixture. In a particularly preferred molar ratio of formic acid/acetic acid is from 0.2:1 to 100:1, preferably between 0.5:1 and 4:1, and most preferably 1:1. The carboxylic acids act as transfer agents, assisting the transfer of alkali bases and/or the alkaline earth bases from a mineral reagent to an organic reagent. Suitable carboxylic acid/alkylphenol molar ratios are selected from about 0.01:1 to 0.5:1, preferably from 0.03:1 to 0.15:1

The neutralization operation is carried out at a suitable temperature, preferably of at least 150° C., preferably at least 215° C., and more preferably at least 240° C. The pressure is reduced gradually below atmospheric in order to distill off the water of reaction. Accordingly the neutralization should be conducted in the absence of any solvent that may form an azeotrope with water. Preferably, the pressure is reduced to no more than 7,000 Pa (70 mbars).

Preferably, at the end of this neutralization step the alkylphenate obtained is kept for a period not exceeding fifteen hours at a temperature of at least 215° C. and at an absolute pressure of between 5,000 and 10.sup.5 Pa (between 0.05 and 1.0 bar). More preferably, at the end of this neutralization step the alkylphenate obtained is kept for between two and six hours at an absolute pressure of between 10,000 and 20,000 Pa (between 0.1 and 0.2 bar).

By providing that operations are carried out at a sufficiently high temperature and that the pressure in the reactor is reduced gradually below atmospheric, the neutralization reaction is carried out without the need to add a solvent that forms an azeotrope with the water formed during this reaction. In fact, under these conditions, in the presence of the given proportion of $C_1$ to $C_4$ carboxylic acid, it is possible to obtain a sufficient degree of conversion of the alkylphenol to alkyl phenate which determines the final metal content.

Carboxylation Step

The carboxylation step is optionally conducted by simply bubbling carbon dioxide into the reaction medium originating from the preceding neutralization step and is continued until at least 2 mole % of the alkylphenate to alkylsalicylate (measured as salicylic acid by potentiometric determination). It must take place under pressure in order to avoid any decarboxylation of the alkylsalicylate that forms. Preferably, the reaction is conducted at a temperature of between 150° and 240° C. and under a pressure within the range of from above atmospheric pressure to $15\times10^5$ Pa (15 bars) for a period of one to eight hours. Said carboxylation step is predominately employed for alkaline earth phenate salts.

Filtration Step

The purpose of the filtration step is to remove sediments, and particularly un-reacted metal base and/or crystalline calcium carbonate, which might have been formed during the preceding steps, and which may cause plugging of filters installed in lubricating oil circuits.

Oil of Lubricating Viscosity

The lubricating oil, or base oil, used in the lubricating oil compositions of the present invention are generally tailored to the specific use e.g. engine oil, diesel engine oil, marine engine oil, gear oil, industrial oil, cutting oil, etc. For example, where desired as an engine oil, the base oil typically will be a mineral oil or synthetic oil of viscosity suitable for use in the crankcase of an internal combustion engine such as gasoline engines and diesel engines which include marine engines. Crankcase lubricating oils ordinarily have a viscosity of about 1300 cSt at 0° F. to 24 cSt at 210° F. (99° C.) the lubricating oils may be derived from synthetic or natural sources.

Mineral oil for use as the base oil in this invention includes paraffinic, naphthenic and other oils that are ordinarily used in lubricating oil compositions. Synthetic oils include both hydrocarbon synthetic oils and synthetic esters. Hydrocarbon synthetic oil may include, for example, oils prepared from the polymerization of ethylene or form the polymerization of 1-olefins, such as polyolefins or PAO, or from hydrocarbon synthesis procedures using carbon monoxide and hydrogen gases, such as in a Fisher-Tropsch process. Useful synthetic hydrocarbon oils include liquid polymers of alpha olefins having the proper viscosity. Especially useful are the hydrogenated liquid oligomers of $C_6$ to $C_{12}$ alpha olefins such as 1-decene trimer. Likewise, alkyl benzenes of proper viscosity such as didodecyl benzene can be used.

Useful synthetic esters include the esters of both monocarboxylic acid and polycarboxylic acids as well as monohydroxy alkanols and polyols. Typical examples are didodecyl adipate, pentaerythritol tetracaproate, di-2-ethylhexyl adipate, dilaurylsebacate and the like. Complex esters prepared from mixtures of mono and dicarboxylic acid and mono and dihydroxy alkanols can also be used. Blends of various mineral oils, synthetic oils and minerals and synthetic oils may also be advantageous, for example to provide a given viscosity or viscosity range.

EXAMPLES

The invention will be further illustrated by the following examples, which set forth particularly advantageous method and compositional embodiments. While the Examples are provided to illustrate the present invention, they are not intended to limit it. This application is intended to cover those various changes and substitutions that may be made by those skilled in the art without departing from the spirit and scope of the appended claims. A further understanding of the invention can be had from the following non-limiting examples.

Example 1

To a 5 liter 4 neck round bottom flask equipped with a mechanical stirrer, Dean Stark trap fitted with a condenser under an atmosphere of dry nitrogen was charged 1392.6 gm (3.3 moles) of $C_{20-28}$ linear alkylphenol followed by 800 gm of Chevron RLOP 100N oil. The $C_{20-28}$ linear alkylphenol was derived from the alkylation of phenol by a mixture of 80 wt-% $C_{20-24}$ olefin and 20 wt-% $C_{26-28}$ olefin. The olefin mixture contained less than 1 wt-% $C_{18}$ or lower olefin, less than 10 wt-% branched olefins, less than 5 wt-% linear internal olefins, and greater than 90 wt-% of linear alpha-olefins. This mixture was heated to 150° C. for approximately 14 hours, then cooled to approximately room temperature and 77.2 gm (1.83 moles) of calcium hydride (98% purity obtained from Aldrich Chemical Company) in approximately 5 gm portions over approximately 40 minutes with stirring. The reaction was then slowly heated to 280° C. over 2.5 hours and then the temperature was lowered to 230° C. and held there for 15 hours. The temperature of the reaction was then increased to 280° C. and held at this temperature for 7.5 hours and then cooled again to 230° C. and held there for 16.5 hours and the temperature increased to 280° C. and held for 7.5 hours and allowed to cool to room temperature over about 16 hours and then heated to 150° C. and filtered through a preheated, dry Buchner funnel containing Celite 512 filter aid with the aid of vacuum to afford a liquid product containing 2.36 wt. % calcium.

Example 2

A charge of 1750 grams of a linear alkylphenol having a molecular mass of about 390 (i.e. 4.49 moles) is placed into a reactor. The linear alkylphenol is derived from a sulfonic acid catalyzed alkylation reaction of a $C_{20-28}$ alpha olefin fraction having approximately 83 wt % n-alpha olefin content with otherwise similar properties as is described in Example 1. The reactor is a four-necked 4 l glass reactor over which is placed a heat-insulated Vigreux fractionating column. The agitator is set at 350 revolutions per minute and the reaction mixture is heated to 65° C.; 112.9 g of lime $Ca(OH)_2$ (i.e. 1.53 moles) and 18.9 g of a mixture (50/50 by weight) of formic acid and acetic acid (i.e. 0.36 mole of this mixture) is added at this temperature. Thereafter, the reaction medium is heated to 120° C. at which temperature the reactor is placed under a nitrogen atmosphere, and then is further heated to 165° C. when the nitrogen atmosphere is stopped; distillation of water commences at this temperature. The temperature is raised to 220° C. in 1 hour, the pressure being reduced gradually below atmospheric until an absolute pressure of 5,000 Pa (50 mbars) is obtained. The reaction mixture is kept for 3 hours under the preceding conditions. The reaction mixture is allowed to cool to 180° C. then the vacuum is broken under a nitrogen atmosphere and a sample is taken for analysis.

The total quantity of distillate obtained is about 19 $cm^3$; demixing occurs in the lower phase (9 $cm^3$ being water), the % sediment (% by vol) is approximately 9 and the TBN by ASTM D-2896 is 13.

B) Carboxylation:

The product obtained from stage A) is transferred to a 3.6 l autoclave to which 640 g of oil 100 N is added and is heated to 180° C. The reactor is scavenged with carbon dioxide ($CO_2$) at this temperature and scavenging is continued for 10 minutes. The amount of $CO_2$ used in this step is of the order of 20 g. The temperature is raised to 200° C. and the autoclave is closed leaving a very small leak and the introduction of $CO_2$ is continued so a pressure of $3.5\times10^5$ Pa (3.5 bars) is maintained for 6 hours at 200° C. The amount of $CO_2$ introduced is of the order of 50 g. Then the autoclave is cooled to 165° C. and the pressure is restored to atmospheric and there after, the reactor is then purged with nitrogen. The recovered product is characterized by a TBN by ASTM D-2896 of 9, a sediment (% by vol) of 9 a Salicylic acid value (mg/KOH/g) of 4.

Having described specific examples of this invention, numerous other Group II metal alkylphenate compositions within the scope of this invention could be prepared merely by substituting one or more reagents for the reagents set forth in these examples. For example, other alkaline earth metal compounds can be used to overbase the phenate compositions of this invention include the barium-containing compounds such as barium hydroxide, barium oxide, barium sulfide, barium bicarbonate, barium hydride, barium amide, barium chloride, barium bromide, barium nitrate, barium sulfate, barium borate, etc.; the calcium-containing compounds such as calcium oxide, calcium sulfide, calcium bicarbonate, calcium hydride, calcium amide, calcium chloride, calcium nitrate, calcium borate, etc.; the strontium-containing compounds such as strontium hydroxide, strontium oxide, strontium sulfide, strontium bicarbonate, strontium amide, strontium nitrate, strontium hydride, strontium nitrite, etc.; and the magnesium-containing compounds such as magnesium hydroxide, magnesium oxide, magnesium bicarbonate, magnesium nitrate, magnesium nitrite, magnesium amide, magnesium chloride, magnesium sulfate, magnesium hydrosulfide, etc. The corresponding basic salts of the above-described compounds are also intended; however, it should be understood that the alkaline earth metal compounds are not equivalent for the purposes of this invention, because under certain conditions some are more effective or desirable than others. The calcium salts are presently preferred, particularly calcium oxide, calcium hydroxide and mixtures thereof.

In addition to the above, the amount of carbon dioxide, group II metal, carbon dioxide or other suitable acid gas for overbasing, etc. can be varied from the examples set forth above to provide for compositions within the scope of this invention.

Comparative Example A

Mixture of Branched $C_{12}$ or Branched dodecyl phenol calcium salt—was prepared from the alkylation of phenol with a branched chain $C_{10}$-$C_{15}$ olefin derived primarily from propylene tetramer. The propylene tetramer has the following carbon distribution:

| Carbon Number | Wt % |
|---|---|
| ≦C10 | 1 |
| C11 | 18 |
| C12 | 59 |
| C13 | 17 |
| C14 | 4 |
| ≧C15 | 1 |

To a 2 liter round bottom flask equipped with a mechanical stirrer, Dean Stark trap fitted with a condenser under an atmosphere of dry nitrogen was charged 607 gm (2.32 moles) of a $C_{12}$ branched alkylphenol followed by 500 gm of Chevron RLOP 100N oil. This mixture was cooled to approximately 17° C. using an ice bath and then 48.8 gm (1.16 moles) of calcium hydride (98% obtained from Aldrich Chemical Company) was added in approximately 10 gram portions with stirring. The last amounts of $CaH_2$ were rinsed into the reaction with the aid of approximately 40 ml of Exxon 100N oil. The reaction was held at approximately 17° C. for approximately 2 hours and then heated to 200° C. over 3 hours, then cooled to approximately 200° C. and held at 200° C. for approximately 17 hours. The reaction was then heated to 250° C. over 50 minutes and held at 250° C. for approximately 38 hours and then cooled to approximately room temperature and held at approximately room temperature for 48 hours. The reaction was then heated to approximately 160° C. and filtered though a Buchner funnel with the aid of vacuum to afford a product with a TBN of 104.

Comparative Example B

Distilled branched $C_{10-12}$ alkylphenol calcium salt.

To a 5 liter 4 neck round bottom flask equipped with a mechanical stirrer, Dean Stark trap fitted with a condenser under an atmosphere of dry nitrogen was charged 607 gm (2.32 moles) of a distilled $C_{10-12}$ branched alkylphenol followed by 500 gm of Chevron RLOP 100N oil. This mixture was heated to 150° C. for approximately 14 hours, then cooled to approximately 20° C. using an ice bath. To the flask was added 42.1 gm (1.16 moles) of calcium hydride (98% obtained from Aldrich Chemical Company) in approximately 10 gram portions with stirring. The reaction was then heated to 270° C. over 1 hour and held at 270° C. for 6 hours and then cooled to 200° C. and held at 200° C. for approximately 64 hours. The reaction was then heated to 270° C. and held at 270° C. for 3 hours and then cooled to 150° C. and filtered through a pre-heated, dry Buchner funnel containing a filter bed of Celite with the aid of vacuum to afford a clear, honey brown product containing 3.82 wt. % calcium.

Comparative Example C

Branched pentadecylphenol calcium salt—was prepared from the alkylation of phenol with a branched chain $C_{14}$-$C_{18}$ olefin derived primarily from propylene pentamer. To a 2 liter round bottom flask equipped with a mechanical stirrer, Dean Stark trap fitted with a condenser under an atmosphere of dry nitrogen was charged 705 gm (2.32 moles) of a $C_{15}$ branched alkylphenol followed by 500 gm of Chevron RLOP 100N oil. This mixture was cooled to approximately 13° C. using an ice bath and then 48.8 gm (1.16 moles) of calcium hydride (98% obtained from Aldrich Chemical Company) was added in approximately 10 gram portions with stirring. The reaction was then heated to 100° C. over 50 minutes and then heated to 200° C. for over 140 minutes and held at 200° C. for approximately 18 hours and then heated to 280° C. over 1 hour and held at 280° C. for 8.5 hours and then cooled to 230° C. and held at 230° C. for approximately 14 hours. The reaction was then cooled to 150° C. and filtered through a dry, hot (150° C.) 600 ml Buchner funnel containing a filter bed of Celite and maintained between 110 and 120° C. with the aid of vacuum to afford a product containing 3.51 wt. % calcium.

Comparative Example D

Mixture branched $C_{12}$ and linear $C_{20-28}$ alkylphenol calcium salt

To a 4 neck 4 liter glass reactor fitted with a heated Vigreux fractionating column and a mechanical stirrer is charged 875 gm (3.24 moles) of a $C_{12}$ branched alkylphenol, prepared similarly as Comparative Example A) and 875 grams of $C_{20-28}$ linear alkylphenol (as described in Example 1). The stirrer is started and the reaction heated to 65° C. at which time 158 gm (2.135 moles) of slacked lime ($Ca(OH)_2$) was added followed by 19 gm of a 50/50 (by weight) mixture of formic and acetic acid. The reaction is then heated to 120° C. at which time the reactor is placed under a nitrogen atmosphere and then heated to 165° C. and the nitrogen turned off. Distillation of water begins and the reaction temperature is increased to 240° C. and the pressure was gradually reduced to 50 mbar absolute. The reaction mixture was held at 240° C. and 50 mbar pressure for five hours. The reaction is then allowed to cool to 180° C. and the vacuum is replaced with nitrogen. A biphasic distillate is obtained consisting of 66 ml water and 57 ml of an organic phase.

The above product is transferred to a 3.6 liter autoclave and heated to 180° C. and then approximately 20 grams of carbon dioxide ($CO_2$) is added over ten minutes. The reaction temperature is raised to 200° C. and the autoclave is closed and approximately 50 grams of carbon dioxide is added over 5 hours at a pressure of 3.5 bars. The autoclave is then cooled to 165° C. and the autoclave pressure is reduced to atmospheric pressure and the autoclave is purged with nitrogen to afford 1,912 grams of crude product which is filtered to afford a final product with the following composition: TBN=118, Ca=4.2 wt. %, Salicylic acid index=49 and approximately 34.8 weight % alkylsalicylate, 12.2% alkylphenate and 53% unreacted alkylphenol.

Assessment

Assessment of Pubertal Development in Juvenile Female CD® (Sprague-Dawley) Rats after exposure to Example 1 and Comparative A-D, Administered by oral gavage. This assessment is a modified version of the toxicology screen referred to as the "female pubertal assay." This assay detects estrogenic and anti-estrogenic activity as well as perturbations to the hypothalamic-pituitary-gonadal/thyroidal axis during the course of twenty days of test substance administration. Effects are detected via changes to the timing of sexual maturation (age at vaginal opening), changes to organ weights, and age at first estrus. This assay is designed to be sensitive to endocrine endpoints, but is an apical design from the perspective that it cannot single out one particular endocrine-mediated mechanism.

It should be noted that the female pubertal assay is an apical assay that may detect chemicals with biological activity upon the hypothalamic-pituitary-gonadal/thyroidal axes. Chemicals that act directly upon the female gonads, such as those described as estrogen mimics, would also be detected in a simpler assay known as the uterotrophic assay. The uterotrophic assay is specific for estrogenicity. However, the female pubertal assay should detect both chemicals that act directly upon the female gonads as well as chemicals that act upon other components in these endocrine axes.

Briefly, the assay is conducted as follows. Suitable female rats, 21 days of age, within the weight range were weaned and randomized into four treatment groups. Each treatment group consisted of fifteen females. Dosage levels were determined and dose volumes were based on daily body weight. Animals were orally dosed with a test compound or the vehicle (Mazola® corn oil) beginning on day 22 and continuing through 41 days of age. A separate vehicle control group dosed with corn oil was run concurrently with each component. Clinical signs were observed twice daily during the experimental period with body weights recorded daily. Beginning with postnatal day "PND" PND 25, animals were examined for vaginal perforation. The day of complete vaginal perforation was identified as the age of vaginal opening, and body weight was recorded on that day. Daily vaginal smears to determine the stage of estrus were performed beginning on the day of vaginal perforation until necropsy. At necropsy on PND 42, females were euthanized and blood was collected from the vena cava for analysis of Thyroid Stimulating Hormone (TSH) and Thyroxine ($T_4$). Uterine, ovary, liver, pituitary, kidney, thyroid and adrenal weights were collected. Body weights, body weight gains, organ weights (wet and blotted) luminal fluid weights, mean day of acquisition of vaginal perforation, mean age of first estrous and estrous cycle length was analyzed using statistical methods, such as by a parametric one-way analysis of variance, (ANOVA) to determine intergroup differences.

TABLE 1

Vaginal Opening and Body Weight of Treated Females

| Compound | Dose (mg/kg/day) | Days to Vaginal Opening | Body Weight at Sexual Maturation |
|---|---|---|---|
| Example 1 | 0 | 31.8 ± 2.04 | 112.8 ± 10.09 |
| | 60 | 33.6 ± 2.72 | 124.6* ± 15.36 |
| | 250 | 32.8 ± 1.52 | 119.0 ± 9.13 |
| | 1000 | 33.4 ± 1.65 | 123.6* ± 12.42 |
| Compound of Comparative A (Test 1) | 0 | 34.5 ± 1.60 | 105.9 ± 11.16 |
| | 60 | 28.3** ± 1.05 | 104.4 ± 11.12 |
| | 250 | 27.9** ± 0.74 | 96.0* ± 10.24 |
| | 1000 | 27.6** ± 0.65 | 74.6** ± 8.61 |
| Compound of Comparative A (Test 2) | 0 | 33.2 ± 2.55 | 110.9 |
| | 5 | 33.3 ± 2.37 | 108.2 |
| | 20 | 32.7 ± 2.06 | 109.5 |
| | 60 | 29.1** ± 2.29 | 89.29* |
| Compound of Comparative B | 0 | 31.8 ± 2.04 | 112.8 ± 10.09 |
| | 60 | 31.1 ± 2.71 | 107.1 ± 16.91 |
| | 250 | 27.0** ± 1.00 | 84.2** ± 8.25 |
| | 1000 | 26.1** ± 0.74 | 77.1** ± 7.43 |
| Compound of Comparative C | 0 | 33.2 ± 2.55 | 110.9 ± 14.71 |
| | 60 | 29.6** ± 2.77 | 89.7** ± 14.65 |
| | 250 | 26.5** ± 0.52 | 75.2** ± 6.64 |
| | 1000 | 27.9** ± 2.07 | 77.4** ± 10.34 |
| Compound of Comparative D | 0 | 36.5 ± 1.60 | 113.9 ± 7.82 |
| | 30 | 33.9** ± 2.22 | 104.5* ± 13.85 |
| | 150 | 28.2** ± 0.41 | 68.2** ± 7.99 |
| | 1000 | 28.5** ± 0.92 | 68.8** ± 3.96 |

*refers to $p \leqq 0.05$ (95% confidence limit)
**refers to $p \leqq 0.01$ (99% confidence limit)

Discussion of Results and Data

The data in Table 1, demonstrate sensitivity of the assay to differentiate among the above compounds in capability to disrupt endocrine function as measured by sexual maturation. In addition, although not listed above in the table, several of the compounds above caused statistically significant ($p \leqq 0.05$ or 0.01) changes in thyroid hormone measurements (T4, TSH), thus demonstrating the ability of the assay to detect perturbations to the thyroid as well as to reproductive endocrinology.

Surprisingly, Example 1 even at very high dosages, showed no evidence of endocrine disruption as measured by a decrease in days to vaginal opening or decrease in body weight at sexual maturation. As illustrated in Table 1, in comparison to the control group, there is little variation across the dosage range. In contrast, all of the comparative compounds showed evidence of endocrine disruption, some even at much smaller dosages. For example, the comparative compounds exhibited a decreasing trend in body weight, with a significant effect at high dose rates, similar decreasing tends were also noted for regarding the average postnatal day of vaginal opening While the invention has been described in terms of various preferred embodiments, the skilled artisan will appreciate that various modifications, substitutions, omissions, and changes may be made without departing from the spirit thereof. Accordingly, it is intended that the scope of this invention be limited solely by the scope of the following claims, including equivalents thereof.

What is claimed is:

1. A lubricating oil composition comprising:

a) a major amount of an oil of lubricating viscosity; and b) a detergent comprising an unsulfurized alkali or alkaline earth metal salt of a reaction product of (1) an olefin having at least 10 carbon atoms, wherein greater than 80 mole % of the olefin is a linear $C_{20}$-$C_{30}$ n-alpha olefin, wherein less than 10 mole % of the olefin is a linear olefin of less than 20 carbon atoms, and wherein less than 5 mole % of the olefin is branched chain olefin of 18 carbons or less, and (2) a hydroxyaromatic compound.

2. The composition according to claim 1, wherein the alpha olefin is derived from the oligomerisation of ethylene.

3. The composition according to claim 2, wherein the alpha olefin is a mixture of alpha olefins.

4. The composition according to claim 3, wherein the alpha olefin contains a major amount of $C_{20}$ and $C_{24}$ alpha olefins.

5. The composition according to claim 3, wherein the alpha olefin mixture contains about 60 to about 90 weight % of $C_{20}$ and $C_{24}$ alpha olefins and 40 to 10 weight % of $C_{26}$ and $C_{28}$ alpha olefins.

6. The composition according to claim 1, wherein the alkali or alkaline earth metal salt is derived from a metal base selected from an alkali oxide or alkali hydroxide.

7. The composition according to claim 1, wherein the alkali or alkaline earth metal salt is derived from a metal base selected from an alkaline earth oxide or alkaline earth hydroxide.

8. The composition according to claim 7, wherein the metal base is selected from the group consisting of calcium oxide, calcium hydroxide, magnesium oxide, magnesium hydroxide, lime and dolomite.

9. The composition according to claim 1, wherein the hydroxyaromatic compound is selected from the group consisting of phenol, catechol, resorcinol, hydroquinone, and pyrogallol.

10. The composition according to claim 9, wherein the hydroxyaromatic compound is phenol.

11. The composition according to claim 1, wherein the hydroxyaromatic compound is selected from the group consisting of catechol, resorcinol, and hydroquinone.

12. The composition according to claim 1, wherein the detergent has a base No. BN as measured according to Standard ASTM-D-2896 from 3 to 60.

13. The lubricating composition according to claim 12, further comprising a second detergent.

14. A lubricating oil composition having a major amount of an oil of lubricating viscosity and an unsulfurized phenate detergent, said phenate detergent consisting essentially of a linear alkylphenol calcium salt derived from an olefin having at least 10 carbon atoms, wherein greater than 80 mole % of the olefin is a linear $C_{20}$-$C_{30}$ n-alpha olefin, wherein less than 10 mole % of the olefin is a linear olefin of less than 20 carbon atoms, and wherein less than 5 mole % of the olefin is branched chain olefin of 18 carbons or less.

15. The composition according to claim 14, wherein the linear $C_{20}$-$C_{30}$ n-alpha olefin contains about 60 to about 90 weight % of $C_{20}$ and $C_{24}$ alpha olefins and 40 to 10 weight % of $C_{26}$ and $C_{28}$ alpha olefins.

* * * * *